US007626104B2

(12) United States Patent
Scriba et al.

(10) Patent No.: US 7,626,104 B2
(45) Date of Patent: Dec. 1, 2009

(54) PIPE ORGAN AND METHOD FOR ITS OPERATION

(75) Inventors: Jürgen Scriba, Rumfordstrasse 23, 80469 München (DE); Markus Harder-Völkmann, Neubiberg (DE)

(73) Assignee: Jürgen Scriba, München (DE)

( * ) Notice: Subject to any disclaimer, the term of this patent is extended or adjusted under 35 U.S.C. 154(b) by 132 days.

(21) Appl. No.: 11/827,960

(22) Filed: Jul. 13, 2007

(65) Prior Publication Data

US 2008/0022838 A1 Jan. 31, 2008

(30) Foreign Application Priority Data

Jul. 14, 2006 (DE) ..... 10 2006 032 800

(51) Int. Cl.
*G10B 1/00* (2006.01)

(52) U.S. Cl. ..... 84/331; 84/333; 84/334; 84/342; 84/348

(58) Field of Classification Search ..... None
See application file for complete search history.

(56) References Cited

U.S. PATENT DOCUMENTS

| | | | | |
|---|---|---|---|---|
| 3,138,052 | A | 6/1964 | Wick | |
| 3,926,087 | A | 12/1975 | Griffis | |
| 4,092,895 | A * | 6/1978 | Zabel | 84/345 |
| 4,178,828 | A | 12/1979 | Henschen | |
| 4,408,517 | A | 10/1983 | Ellen | |
| 5,508,472 | A * | 4/1996 | Hawkins | 84/653 |

FOREIGN PATENT DOCUMENTS

| | | |
|---|---|---|
| DE | 24 48 090 | 4/1976 |
| DE | 88 03 302 | 6/1988 |
| DE | 9013030.8 | 1/1991 |
| DE | 9013029.4 | 3/1991 |
| DE | 9418 616.2 | 1/1995 |
| DE | 9418 796.7 | 1/1995 |
| DE | 213 077 | 9/2002 |
| GB | 2 004 106 | 3/1979 |
| WO | 2006/037221 | 4/2006 |

* cited by examiner

*Primary Examiner*—Marlon T Fletcher
(74) *Attorney, Agent, or Firm*—Dilworth & Barrese LLP

(57) ABSTRACT

The invention relates to a method for the operation of a pipe organ, with at least one of the valves being provided as a valve actuated in multiple ways which can be controlled to open at least on the basis of two different note demands. In accordance with the invention, on a note demand on a valve actuated in multiple ways which is already open due to another note demand, the valve actuated in multiple ways is closed for an interruption time period and then opened again. The invention further relates to a method for the operation of a pipe organ, wherein information input at the console is transmitted via a data bus to remote receiver units which are connected to valves and/or stop pallets for their control, with the receiver units determining individually from the information transmitted whether, and if so, which of the valves and/or stop pallets connected to the respective receiver unit are to be opened or closed. The invention further relates to a pipe organ with which the method in accordance with the invention can be carried out.

24 Claims, 5 Drawing Sheets

Prior Art

| | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|
| c0 | | | | | | | | | | | c1 | | | | | | | | | | | c2 | | | | | | | | | | | 16' stop |
| c2 | | | | | | | | | | | c3 | | | | | | | | | | | c4 | | | | | | | | | | | 4' stop |
| c1 | | | | | | | | | | | c2 | | | | | | | | | | | c3 | | | | | | | | | | | 8' stop |
| I | I | I | I | I | I | I | I | I | I | I | I | I | I | I | I | I | I | I | I | I | I | I | I | I | I | I | I | I | I | I | I | I | I | |
| c | d# | e | e# | f | f# | g | g# | a | a# | b | c | d# | e | e | f | f# | g | g# | a | a# | b | c | d# | e | e | f | f# | g | g# | a | a# | b | Keys |
| 1 | 1 | 1 | 1 | 1 | 1 | 1 | 1 | 1 | 1 | 1 | 2 | 2 | 2 | 2 | 2 | 2 | 2 | 2 | 2 | 2 | 2 | 3 | 3 | 3 | 3 | 3 | 3 | 3 | 3 | 3 | 3 | 3 | |

Figure 3

Prior Art

Prior Art

PIPE ORGAN AND METHOD FOR ITS OPERATION

BACKGROUND OF THE INVENTION

The invention relates to a pipe organ and to a method for its operation, in particular to a method for the operation of a pipe organ having a plurality of pipes which are activated via valves, with at least one of the valves being provided as a valve actuated in multiple ways which can be controlled to open on the basis of at least two note demands, and to a corresponding pipe organ.

A distinction is made in classical organ building between a stop action and a note (key) action, with the pipes of the organs being controlled in a matrix scheme. As a rule, an organ comprises a plurality of claviatures (keyboards) which are activated by hand (manuals) and foot (pedals). In the present text, the term "key" will be used to designate the keys of a manual to be activated by the fingers and the keys of the pedal to be actuated by feet. As a rule, each keyboard has a "division" associated with it which comprises a number of pipes mounted on one or more windchests through which the air supply into the individual pipes is controlled.

FIG. 3 symbolizes this arrangement schematically for the example of a customary note channel windchest. Valves are arranged next to one another in the horizontal direction and are actuated, in the simplest case, directly by a key in the associated manual/pedal. If the valve is opened, air flows in a channel which is disposed behind/above it and is shown vertically in the scheme. Pipes of different timbre or pitch are located on this channel. Which of these sounds when the key is pressed depends on which stop is "pulled out" (switched). In the case of a slider chest, e.g. a strip of wood with holes opens all the pipes of one timbre. This is shown as follows, by way of example, in the scheme of FIG. 3, with the octave ranges being designated in the present text for better clarity as c0, c1, c2, etc. and not with the designations usual in music of C1, C, c, etc. An 8' pipe (eight foot pipe) sounds in the normal range; a 4' pipe (four foot pipe) one octave higher; and a 16' pipe (sixteen foot pipe) one octave lower. If the 8' stop has been pulled out (switched), the pipe with the pitch c1 sounds when the lowest c key ("c1") is pressed. If the 4' stop has been pulled out, the note c2 sounds, etc.

Generally, with this principle of construction there is at least one pipe per stop for each key. Keyboards can be connected to one another via optionally provided couplers so that e.g. the pipes associated with the second manual also sound when the first manual is being played. "Borrows" are also used which allow some pipes associated with one manual also to be used in other manuals through additional valves. Couplings are also known which are used within a division to actuate additional notes, for example at intervals of an octave.

In the course of development of organ making, different systems were developed which effect the connection between the key and the pipe using electromagnetic or pneumatic means or which combine mechanical, pneumatic and/or electrical actions with one another (e.g. because a plurality of mechanically coupled manuals can only be played with a large expenditure of force). The basic principle in the known systems can be found in the fixed association of key and stop, on the one hand, and pipe, on the other hand.

The construction of such an organ is very complex and/or expensive and contains a number of pipes in a plurality of configurations. The system of FIG. 3, for example, includes the pipe sounding as c2 both in the 8' stop of the note c2 and in the 4' stop of the note c1. Systems have been developed whose aim was also to create a similar sonority with a lower effort and/or cost. With so-called multiplex organs, the pipes can thus be controlled individually via a respective valve and, instead of stops, so-called stop knobs of pipe ranks are switched whose extent of notes goes beyond that of the keyboards. Such multiplex systems (also known as "units" in the English-speaking world) control different pipes of a pipe rank depending on which stop is switched, when a key is actuated. The octave positions 16', 8' and 4' can thus be formed e.g. by stop knobs of the pipe rank.

FIG. 4 shows a scheme of such a multiplex organ. When the key c2 is pressed with a switched 8' stop, the pipe c2 is adressed. If the 4' stop is switched, the c3 pipe is also adressed; the 16' stop adresses the c1 pipe.

Conflicts can arise with such multiplex organs if a pipe is adressed in different ways. In this connection, a so-called borrowing hole can occur when a pipe which should be played in the course of a sequence of notes does not respond audibly again because its valve had already been opened by a stop knob switching. In the scheme of FIG. 4, this situation would e.g. occur if the 4' and 8' stops are switched and the key c2 is held. In this case, pipes c2 and c3 sound. If now e.g. a scale from g2 to g3 is simultaneously played on another manual, the note c3 appears to be missing when it is played, because the pipe c3 does not respond again when the key is pressed because it is already sounding.

Valves which can be controlled to open in this respect due to at least two different note demands, are also called "valves actuated in multiple ways" for the purposes of the present text. The term "note demand" on a pipe is used when it results from corresponding settings on the console, key pressing, stop switches, etc. that the pipe should sound. The term "organ" does not only include the arrangement of the pipes, but the totality of the pipes, stops, etc. and their control units.

The construction principle of known electronic control systems comprises evaluating key information and stop information in a control unit and deriving control signals for stop pallets, valves or individual pipes from this. Optionally, a plurality of stop combinations (timbres) can be stored ("set") before a performance and can be called up by the press of a button during the performance.

The known principle of electronic organ control systems will be explained with reference to FIG. 5. Information on pressed keys on the keyboards 220 and on switched stops 240 are first supplied at the console 340 via individual cables 320 to a control unit 100 which derives control signals, e.g. for stop magnets and valves, from it. The control information determined in this manner is e.g. converted with the help of an electronic multiplexer and is transmitted serially to the switch stage 102 via the common data line 104. The information obtained serially is converted there, e.g. with the help of an electronic demultiplexer, such that the information intended for the individual valves 160 can be given to the individual valves 160 via individual cables 300. A similar architecture is described in the German utility model DE 88 03 302 U1, with a light waveguide being used as a data line there.

The term of electronic multiplexer or demultiplexer used in connection with the data transfer is not to be confused with the term multiplex organ which is used in connection with organs and which is characterized by the possible use of a pipe for a plurality of different note demands.

A method for the operation of a pipe organ and a pipe are also known from DE 213077 C.

SUMMARY OF THE INVENTION

It is an object of the present invention to provide a method for the operation of a pipe organ and a pipe organ which also avoid the occurrence of audible borrowing holes on the use of individual valves or a plurality of valves as valves actuated in multiple ways.

This object is satisfied by a method and a pipe organ having the features herein. Preferred embodiments are also described herein.

In the method in accordance with the invention, with a note demand on a valve that is already opened due to another note demand, said valve actuated in multiple ways is closed for an interruption time period and then opened again.

As stated, a borrowing hole can occur when a pipe should be played in the course of a sequence of notes whose valve had already been opened due to another note demand, e.g. by a stop knob switching. It has been found that the acoustic impression of a borrowing hole does not arise because the note is not sounding, but because the characteristic attack point phase of the pipe does not become audible which, depending on the type of construction of the pipe, has a different sound spectrum than the stationary note and can even be associated with a special chiff sound. The method in accordance with the invention prevents the borrowing hole in that, in the event of a collision of a further note demand with an already existing note demand, the corresponding valve actuated in multiple ways is closed for a short time and then opened again. This method in accordance with the invention is called "borrowing hole masking" in the following.

Due to the borrowing hole masking method in accordance with the invention, the brief closing of the valve actuated in multiple ways and the subsequent reopening generates an attack point phase such as would arise if the note were being played for the first time. The problem of the borrowing hole which occurs due to the multiple utilization of individual pipes and valves in known solutions is effectively prevented by the method in accordance with the invention and the sound of the organ, in particular of the pipes controlled by valves actuated in multiple ways, is noticeably improved for the listener.

It has been found that a brief closing between 40 ms and 70 ms of a valve actuated in multiple ways makes a new attack point phase easily audible. If the closure time is in the region from 10 to 100 ms, this attack point phase is perceived without the delay in the note played resulting therefrom being perceived as irritating.

The closure time needed to make the new attack point phase audible depends on the construction and on the pitch of the respective pipe. Although interruption time periods of longer than 10 ms, preferably longer than 40 ms, or interruption time periods of shorter than 100 ms, preferably shorter than 70 ms, have proven to be particularly favorable, it is of advantage if the interruption time period is adjustable. In a further development of the method in accordance with the invention, the interruption time periods for the valves of different organ pipes are set to be of different length.

A pipe organ in accordance with the invention with which the method in accordance with the invention for the operation of a pipe organ can be carried out for borrowing hole masking in particular has an especially designed control. The control serves the purpose of generating control signals for the valves from the information input at the console. In this connection, the console can include a plurality of keyboards (e.g. manual and pedals). Information input at the console includes e.g. information on pressed keys, switched stops or stop knobs and/or set couplings.

The pipe organ in accordance with the invention, in particular configured for borrowing hole masking, has a control which is configured such that, in the event of a note demand on a valve which is already open due to another note demand, it closes this valve actuated in multiple ways for an interruption time period and then opens it again. The advantages which result with such a pipe organ in accordance with the invention have already been described above with reference to the method in accordance with the invention for the operation of a pipe organ for borrowing hole masking.

In a further development of this pipe organ in accordance with the invention, the valves are configured to be electrical, preferably electromagnetic, piezoelectric or electropneumatic. In such an embodiment, for the closing of a valve used as a valve actuated in multiple ways, the power supply to the valve actuated in multiple ways is interrupted during an interruption time period. Such a configuration can be realized simply and works with a reliable function.

The control of a pipe organ in accordance with the invention can advantageously be programmed such that interruption time periods of different length can be set for the valves of different organ pipes. In this manner, the borrowing hole masking in accordance with the invention can be precisely adjusted to the different construction and pitch of the individual pipes so that the new attack point phase is ideally adjustable for the prevention of an audible borrowing hole.

With a configuration of the method and an embodiment of the pipe organ having the features herein, an increased flexibility and an improved system architecture is made possible.

In the configuration of the method in accordance with the invention, the information input at the console of the pipe organ is transmitted to remote receiver units via at least one data bus. The information input at the console of the pipe organ includes e.g. information on pressed keys, switched stops, stop knobs or adjusted couplings. The receiver units are designated as "remote" in the present text if they are not arranged in or at the console, but e.g. in the vicinity of the pipes.

In this connection, the information input at the console is transmitted directly via the at least one data bus without first having to be converted e.g. by an electronic multiplex process.

The receiver units are connected to valves and/or stop pallets. A group of pipes, in particular the pipes of a respective windchest, are preferably associated with a receiver unit.

The individual receiver units in this configuration determine individually from the totality of the information transmitted whether pallets or valves associated with the respective receiver unit are to be opened or closed. If this is the case, it is additionally individually determined which of the pallets or valves of the respective receiver unit have to be controlled. Finally, the receiver units control the pallets or valves with respect to their opening or closing on the basis of this determination.

The information on pressed keys, switched stops, etc., is transmitted via at least one data bus in this configuration. The information can be evaluated by as many receiver units as desired in the organ and is available to all receiver units. Which pipe or which stop within the region of the respective receiver unit is controlled is calculated individually by each individual receiver unit from the stop and key information which is available to it via the data bus. Because all the key and stop information is transmitted to all receiver units, any desired pipe can be associated with any desired key and stop switch.

In addition to the valves and/or stop pallets, other actuators can also be addressed via the data bus and associated with individual receiver units, e.g. actuators for swells, tremulants or percussion instruments.

The individual receiver units are e.g. each associated with a windchest or a pipe rank. Ideally, the method uses a system which is configured such that multicore cable connections between the valves and/or pallets on the one hand and the receiver units on the other hand are kept as short as possible and the long distances between the different units of the organ are bridged by the at least one data bus.

This configuration of the method in accordance with the invention is therefore characterized by a decentral evaluation of key information and stop information. It is thereby e.g. also possible also to define new stops from stop knobs of different pipe ranks and divisions, optionally also spatially separate pipe ranks and divisions, or to add pipes from other stops to constructionally available stops in individual pitches. Any desired transitions can be provided between pipe ranks of different construction which only match one another in the sound character in specific positions. The transition points can be varied depending on the demand and be matched on the voicing to the sound development of the stops, that is e.g. in the tuning after the constructional completion of the organ.

The method described provides a substantial gain in flexibility and design possibilities for the organ builder and voicer. A change in the pipe configuration by an uncomplicated software update of the receiver units makes simple sound corrections possible.

In a particularly simple configuration of the method in accordance with the invention, the transfer of in particular the information on keys pressed at the console and on stops switched at the console can be carried out via the same data bus. Only one data bus connection is required between the console and the receiver units.

In another simple and clear configuration, the information on keys pressed at the console is transmitted via a first data bus and the information on stops switched at the console via a second data bus. Further data buses which are associated with sensible common units (e.g. via adjusted couplings or stop knobs) can likewise be provided. This information is otherwise also transmitted via the first and/or second data bus.

In a particularly preferred configuration, the determination carried out in the receiver units as to whether or which valves and/or stop pallets connected to this receiver unit should be adressed takes place based on a set of rules. This set of rules is preferably programmed into a memory of the respective receiver unit in the voicing procedure.

During the voicing of the instrument, the voicer tunes the timbres of the pipes of a stop and the sound relationships of a stop with respect to one another. In this embodiment of the method in accordance with the invention, the voicer can, for example, connect a laptop computer to the interface anyway present at the console for the infeed of data and can change the set of rules of the individual receiver units via a text-based or graphical user interface.

The same data bus is preferably used for this which serves for the transfer of the information input at the console to the receiver units during the operation of the organ.

Basically, the demands for the individual valves can be determined from the information input at the console, e.g. via pressed keys and switched stops by the receiver units using the control method without additional stop pallets being required.

Since the receiver units can control both valves and stop pallets depending on the programming, this system architecture is, however, also suitable for the realization of hybrid organs in which classically built note or stop channel windchests are combined with windchests with individual valves. The advantage thereby in particular arises that already existing organs can be expanded for the increasing of the sound volume without interfering in the architecture which may not be changed. This can be of interest e.g. for cost reasons or for reasons of preservation orders if an existing organ should not be changed in its substance even though a greater sound volume would be desirable.

A pipe organ of the embodiment herein includes a control which prepares control signals for valves and/or stop pallets from information input at the console. The control includes a plurality of remote, individual receiver units which are connected to valves or stop pallets for their control and with individual valves or pallets preferably being combined in groups and one group being associated with one receiver unit in each case.

Each receiver unit has a determination device which determines from transmitted information whether and, if so, which valves and/or stop pallets connected to the respective unit are to be opened or to be closed.

In addition, even further actuators can be associated with the receiver units, e.g. actuators for swells, tremulants or percussion instruments, which are likewise controlled with the help of the information transmitted via the data bus.

At least one data bus is used for the transmission of this information from the console to the individual receiver units. This configuration of the pipe organ in accordance with the invention is therefore characterized by a decentral design. Each individual receiver unit has access to all data input at the console and can determine individually whether a note demand on one of the valves or stop pallets connected to it or, optionally, on further actuators result from this information.

Each receiver unit has a non-volatile memory in which sets of rules can be stored with whose help the receiver unit can determine whether one of the valves or stop pallets connected to it should be opened or closed from the information on pressed keys and switched stops made available to it.

Further advantages of a pipe organ configured in accordance with the invention and advantageous configurations thereof result from the advantages and special configurations shown above with reference to the method of the present invention.

The advantages of the decentral system architecture become visible in particular with the borrowing hole masking in accordance with the invention, since central control units create the problem that the complexity of the control program and the requirement of computing power and memory requirements increases in an above-linear manner with the number of manuals, stops and pipes.

BRIEF DESCRIPTION OF THE DRAWINGS

Embodiments of the method in accordance with the invention and of the pipe organ in accordance with the invention will be explained in detail with reference to the enclosed schematic Figures. There are shown:

FIG. 3 the scheme of a note channel matrix arrangement of the prior art;

DESCRIPTION OF THE PREFERRED EMBODIMENTS

Figure 1:
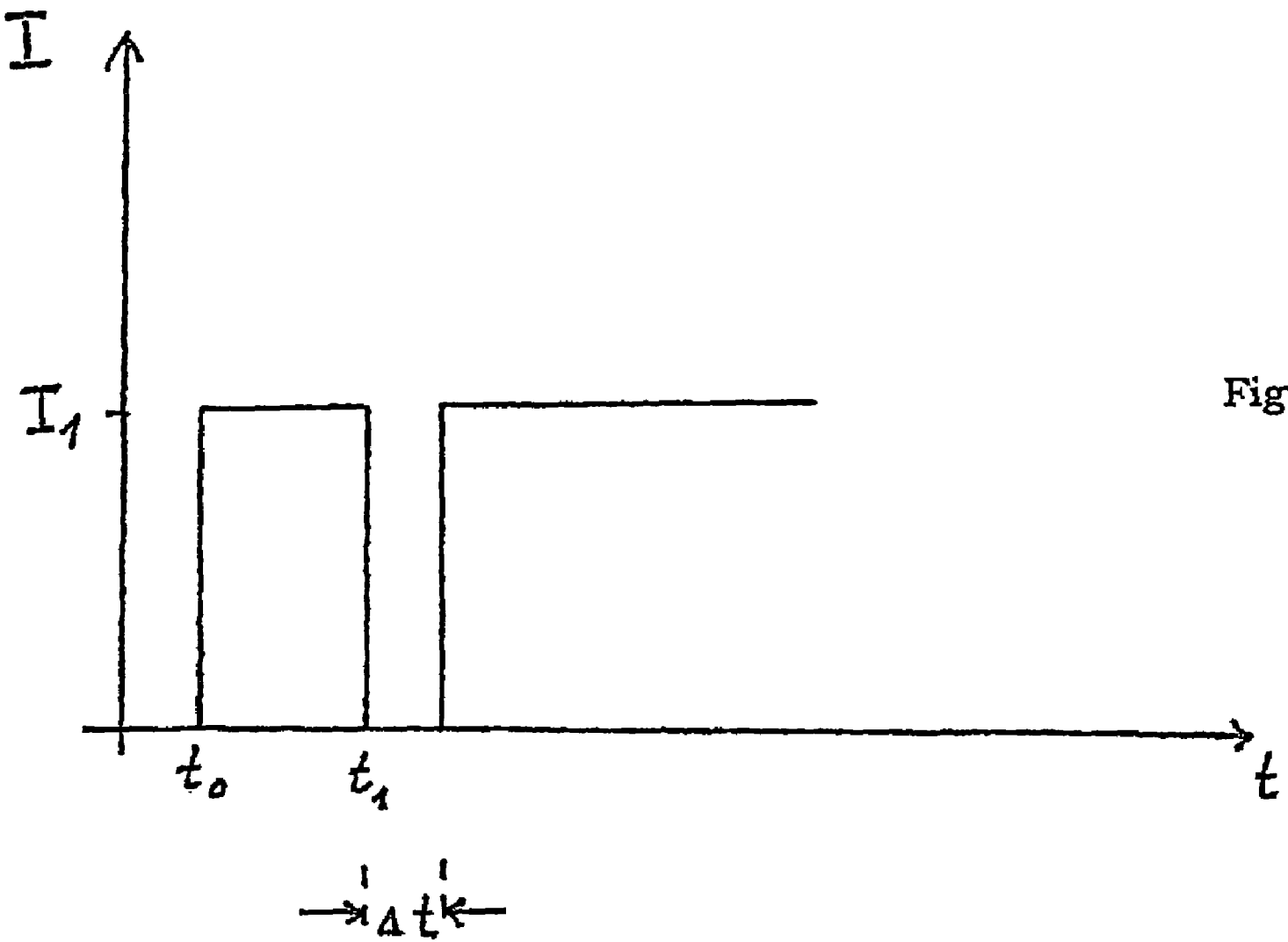
FIG. 1 the power supply in dependence on the time at an electromagnetic valve for a method for borrowing hole masking in accordance with the invention.

In FIG. 1, the power supply to a valve used as a valve actuated in multiple ways is shown by way of example in dependence on the time, with it being an electromagnetically controlled valve. At a time to, a note demand e.g. results at the respective valve due to the setting of a respective stop knob and a corresponding pressing of a key.

For example, the 4' stop and the 8' stop are switched ("pulled") and the key c2 is pressed at the time $t_0$. In this case, the pipe c2 sounds (because the 8' stop is pulled), but also the pipe c3 (because the 4' register is pulled). In the following, the valve actuated in multiple ways corresponding to the pipe c3 in this process is looked at in more detail.

The power supply to the valve of the pipe c3 is set due to this first note demand to the value $I_1$, at which it is open, at the time $t_0$. At a time $t_1$, a further note demand results at this selected valve, e.g. because a sequence of notes is played which includes the corresponding note. For example, the scale g2 to g3, which includes the note c3, is played on another manual. In order also to make the typical chiff sound of the corresponding pipe (here the c3 pipe) audible in this sequence of notes, even though the valve of the pipe is already open, initially the power supply is automatically interrupted at this valve actuated in multiple ways, for a period Δt, so that the valve is closed. The interruption period Δt is selected e.g. between 40 and 70 ms.

After the end of the interruption time period, the power supply at the corresponding valve actuated in multiple ways (here of the pipe c3) is again set up to $I_1$ so that the valve is open again and the pipe sounds.

Due to the brief length of the interruption time period Δt, no audible interruption or delay arises for the listener. On the other hand, the typical chiff sound of the corresponding pipe in the sequence of notes is nevertheless audible.

The borrowing hole due to the missing attack point phase which is considered unpleasant with multiplex organs in which a plurality of note demands can be made on individual pipes is thus avoided.

Figure 2:
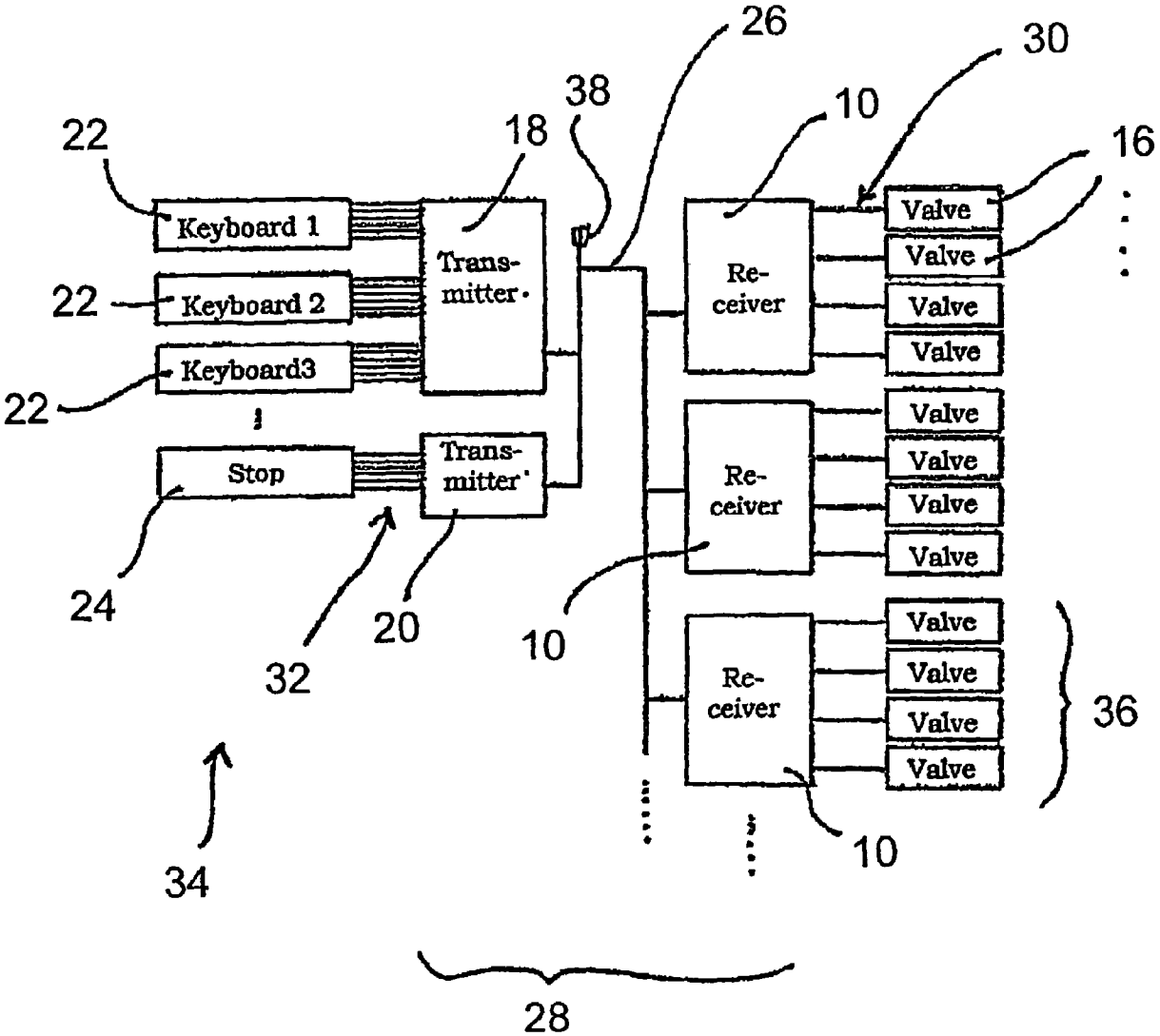
FIG. 2 the system architecture of an embodiment of an organ in accordance with the invention.
Figure 4:
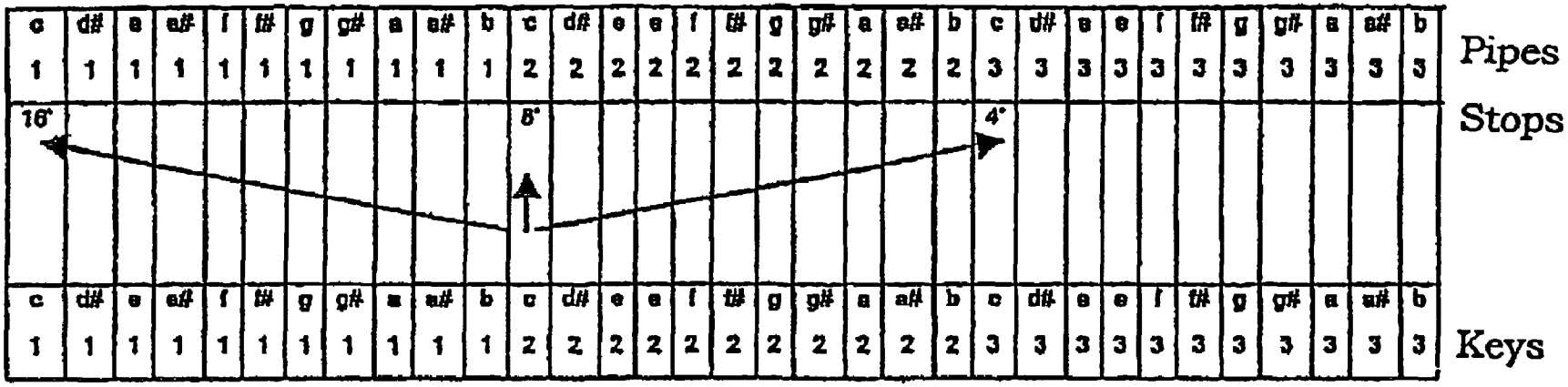
FIG. 4 an example of the control of a multiplex organ of the prior art.
Figure 5:
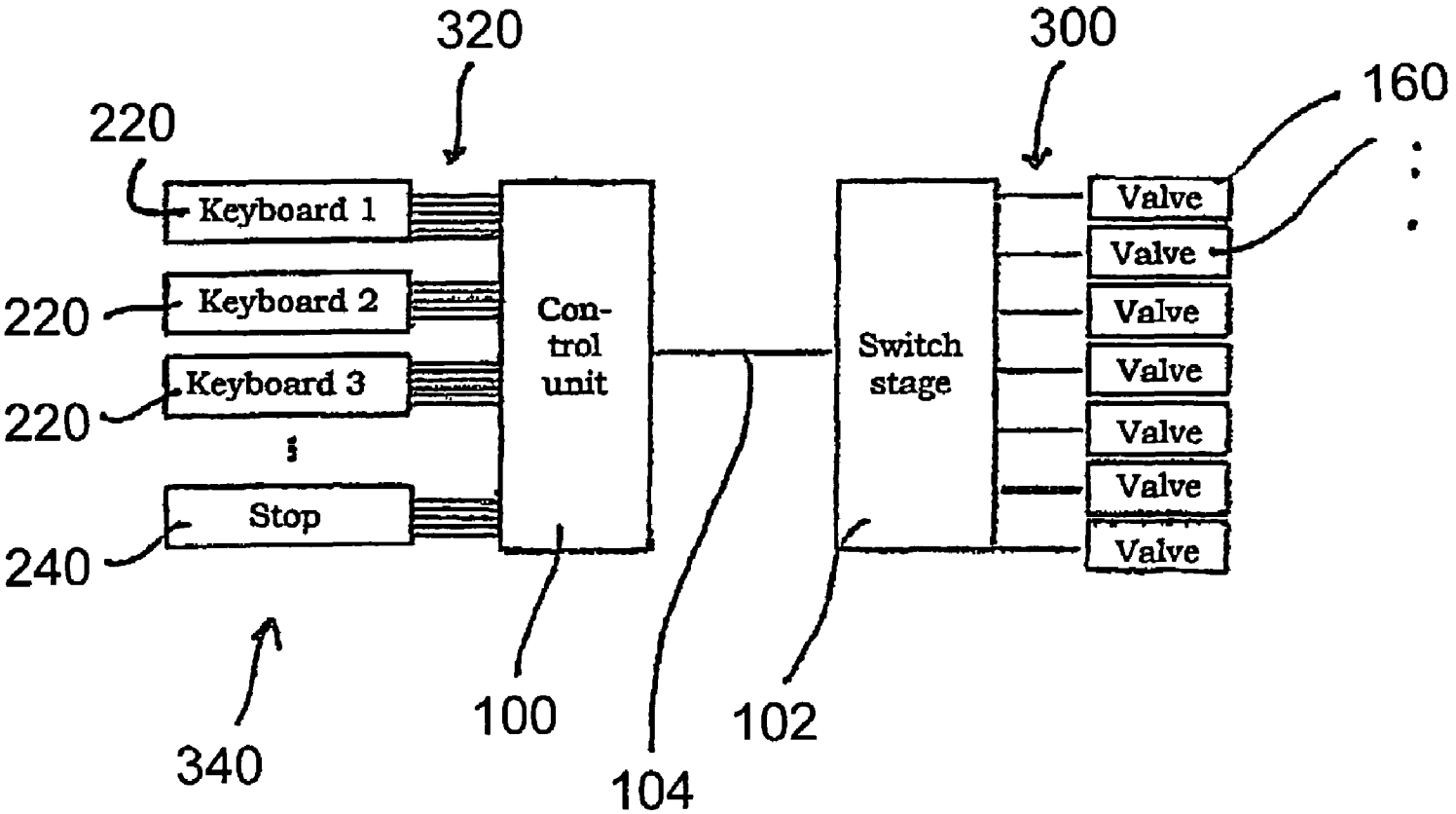
FIG. 5 the system architecture of an electronically controlled organ of the prior art.

FIG. 2 shows the system architecture of a configuration of an organ in accordance with the invention with a decentral design. Keyboards 22 and stops 24 receive information on keys pressed and stops switched by the player on the console 34. This information is transmitted to transmitters 18, 20 via short cables 32. These transmitters pass the information, optionally in encoded form, to a common data bus 26 via which the receivers 10 obtain the information on pressed keys or switched stops. Optionally, e.g. information on set couplings or stop knobs are transmitted on the same path. The totality of the transmitters 18, 20 of the data bus 26 and of the receivers 10 forms the control unit 28. The individual receivers 10 are connected to the valves 16 via short cables 30 which can be combined e.g. in groups 36 which are each associated with a single receiver 10. The valves of a group 36 belong e.g. to the pipes of a windchest. Individual valves, a plurality of valves or all valves 16 can be used e.g. as valves actuated in multiple ways in the sense explained above and react to this extent to different note demands.

A jack is designated by the reference numeral 38 which can direct the signal transmitted via the data bus 26 e.g. to a PC or a memory device or which can supply a corresponding signal to the data bus.

The operation of an organ having the system architecture in accordance with the invention will be explained for the example of the signals from keys and stops. The signals of the keys (usually communicated by one contact or sensor per key) are converted in the console 34 into digital data by one or more transmitter assemblies 18. The information is likewise converted into digital data via active stops (manually actuated or called up by setters) in one or more transmitter assemblies 20. The data are communicated via a common serial data bus 26. For this purpose, the midi protocol is e.g. suitable in which a message "note-on" is generated when a key is actuated and a "note-off" message is generated when the key is released. Alternatively, the state of all keys and stops can also be transmitted as bit patterns periodically with a high repeat rate. All types of interfaces, e.g. connections in accordance with the RS485 standard are suitable as the transmission channel. Wired (Ethernet) or wireless, packet-based networks such as TCP/IP networks can equally be used.

If e.g. the midi standard is used for the transmission of notes and stops, each note is e.g. identified by a number 0 . . . 127 and each keyboard by a midi channel 1 . . . 16. Stops are likewise represented by notes or by controller information which are transmitted on different midi channels.

Typical rules which are defined in the receiver define, e.g. dependent on the switched stops, on which midi channel notes should be received and with which switch output a specific note or note ranges should be linked.

The SysEx protocol of the midi standard can e.g. be used for the reprogramming of the receiver units. For the association of the transmitted rules with a specific receiver unit, each receiver unit contains an individual address which can be set, for example, by encoding switches at the receiver unit on the installation. A corresponding configuration program of the voicer makes it possible to change one or more sets of rules on one or more received units selected by their individual address in that data packets are transmitted over the general data bus 26. These configuration packets are identified e.g. by a special code which are recognized by the receiver units and mark the corresponding data packets as "non-note" packets. The receiver units use such data packets for changing the sets of rules which are responsible for them and which are stored in the memory units of the individual receiver units.

It is generally also feasible that the midi signal is taken up e.g. at the jack 38 when an organ piece is being played and is supplied to a PC and/or to a memory device. At a later point in time, this signal can be played back into the system, e.g. likewise via the jack 38, and can be made available to the receiver units 10 so that they are enabled to determine and initiate the corresponding note demands on the valves 16. It is thus basically possible to have an organ piece played by the organist at one time played back automatically at a later time. It is also possible in this context that the console 34 and the arrangement of receivers 10 and valves 16 are set up at different positions and the data bus connection 26 is interrupted. For the later playback of an organ piece played by the organist at the console 34 and supplied to a memory device via the jack 38, the console 34 then no longer has to be utilized for this use.

The decentral organization of a pipe organ in accordance with the invention is characterized by extreme flexibility which enables the use of this control. Almost any desired association of pipes with stops and keys is possible without the requirements for computing power and memory becoming too large, as may be the case with central control units. Organs with already present electromechanical valve actuation (e.g. electromagnetic, electropneumatic) can be redesigned, retrofitted or converted. Mechanically designed organs can be expanded to include electrically actuated stops or new playing aids can be implemented in mechanical organs by partial electrification.

This system architecture can be used particularly advantageous with a method in accordance with the invention and a pipe organ in accordance with the invention which utilize the borrowing hole masking in accordance with the invention described above. If a receiver unit recognizes a collision between a new note demand at one of the pipes connected to it and an already existing note demand by which the valve of this pipe has already been opened, it initiates the closing of the corresponding valve for a predetermined interruption time period Δt. For this purpose, e.g. the power supply to an electromagnetically actuated valve is interrupted by the responsible receiver unit.

REFERENCE NUMERAL LIST

10 receiver unit
16 valve
18, 20 transmitter unit
22 keyboard
24 stop
26 data bus
28 control
30, 32 cable
34 console
36 valves of a windchest
38 jack
100 control unit
102 switch stage
104 multiplex data line
160 valves
220 keyboard
240 stop
300, 320 cable
340 console
$t_0$ time of a first note demand
$t_1$ time of a second note demand
Δt interruption time period

The invention claimed is:

1. A method for the operation of a pipe organ having a plurality of pipes which are addressed via valves, comprising the steps of providing at least one of the valves to be actuated in multiple ways and controlled for opening at least on the basis of two different note demands, and on a further note demand on a valve actuated in multiple ways which is already open due to an initial note demand, closing the valve actuated in multiple ways for an interruption time period (Δt) and then opening this valve again.

2. A method in accordance with claim 1, wherein the interruption time period (Δt) is longer than 10 ms, preferably longer than 40 ms.

3. A method in accordance with claim 1, wherein the interruption time period (Δt) is shorter than 100 ms, preferably shorter than 70 ms.

4. A method in accordance with claim 1, wherein the interruption time period (Δt) for the valves of different organ pipes is set at a different length.

5. A method in accordance with claim 1, comprising the steps of transmitting information input at the console (34) of the pipe organ via at least one data bus (26) to remote receiver units (10) which are connected to valves and/or to stop pallets for the control thereof;

the receiver units (10) determining individually, from the transmitted information, whether and which of the valves (16) and/or stop pallets connected to the respective receiver unit (10) are to be opened and/or closed; and the receiver units (10) controlling one or more valves (16) and/or stop pallets for the opening or closing thereof on the basis of said determination.

6. A method in accordance with claim 5, wherein a receiver unit (10) is in each case connected to the valves and/or stop pallets of a group (36) of pipes, in particular the pipes of a windchest, for the control thereof.

7. A method in accordance with claim 5, wherein the same data bus (26) is used for the transmission of the information to the receiver units (10), in particular on keys pressed at the console (34) and stops switched at the console (34).

8. A method in accordance with claim 5, comprising the steps of transmitting information on keys pressed at the console via a first data bus and information on stops switched at the console via a second data bus.

9. A method in accordance with claim 5, wherein the determination step takes place within the individual receiver units (10) on the basis of one respective set of rules which is programmed, preferably on the voicing, into a preferably non-volatile memory of the respective receiver unit.

10. A method in accordance with claim 9, wherein the programming of the memory of the receiver units (10) is carried out via the same data bus (26) via which the information input at the console (34) is transmitted to the receiver units (10).

11. A method in accordance with claim 5, wherein other actuators, in particular for swells, tremulants or percussion instruments are associated, in addition to the valves and/or stop pallets, with one or more receiver units and the receiver units additionally determine from the information transmitted whether one or more of these actuators are to be actuated and actuate them on the basis of this determination.

12. A method in accordance with claim 1, comprising the steps of setting power supply to said actuated valve at a certain value ($I_1$), then, upon said further note demand occurring, automatically interrupting said power supply for said interruption time period (Δt), and at the end of said interruption time period (Δt), again setting said power supply up to said certain value ($I_1$) to open said valve again.

13. A pipe organ comprising a plurality of pipes which are addressed via valves (16);

a control (28) which generates control signals for the valves (16) from information input at a console (34), wherein at least one of the valves (16) is actuatable in multiple ways and controlled for opening on the basis of at least two different note demands resulting from information input at the console (34), and the control (28) is configured such that, on a note demand on a valve actuated in multiple ways which is already open on the basis of a previous note demand, the valve actuated in multiple ways is closed for an interruption time period (Δt) and then opened again.

14. A pipe organ in accordance with claim 13, wherein the valves (16) are operated electrically, preferably electromagnetically, piezoelectrically or electropneumatically, and, for the closing of a valve actuated in multiple ways during an interruption time period (Δt), the power supply to said valve actuated in multiple ways is interrupted.

15. A pipe organ in accordance with claim 13, wherein the control (28) can be programmed such that interruption time periods (Δt) of different lengths can be set for the valves of different organ pipes.

16. A pipe organ in accordance with claim 13, having a control (28) which prepares control signals for valves (16) and/or stop pallets from information input at the console (34), with the control comprising the following:

a plurality of remote, individual receiver units (10) which are connected to valves (16) and/or stop pallets for the control thereof, with each receiver unit (10) including a determination device which determines from information transmitted whether and, if so, which of the valves (16) and/or stop pallets connected to the respective receiver unit (10) are to be opened and/or closed; and at least one data bus (26) which transmits the information input at the console (34) to the receiver units (10).

17. A pipe organ in accordance with claim 16, wherein a receiver unit (10) is in each case connected to the valves and/or stop pallets of a group (36) of pipes, preferably the pipes of a windchest, for the control thereof.

18. A pipe organ in accordance with claim 16, comprising a first data bus for the transmission of the information on keys pressed at the console to the receiver units and a second data bus for the transmission of the stops switched at the console to the receiver units.

19. A pipe organ in accordance with claim 16, wherein the information on pressed keys and switched stops input at the console (34) are transmitted to the receiver units (10) via the same data bus (26).

20. A pipe organ in accordance with claim 16, wherein each receiver unit (10) includes a memory, preferably a non-volatile memory.

21. A pipe organ in accordance with claim 16, wherein the control (28) is structured and arranged to generate control signals for other actuators, in particular for swells, tremulants and/or percussion instruments, in addition to the control signals for valves (16) and/or stop pallets, which are connected to the receiver units in order to be controlled by it, and the determination devices of those receiver units which are connected to additional actuators are structured and arranged to determine from the information transmitted whether and which of the additional actuators connected to the respective user unit are to be actuated.

22. A pipe organ in accordance with claim 13, wherein the valves (16) are operated electrically, preferably electromagnetically, piezoelectrically or electropneumatically.

23. A pipe organ in accordance with claim 13, additionally comprising a power supply for actuating said actuatable valve by providing power to said valve at a certain value ($I_1$), wherein said control (28) is structured and arranged to (i) interrupt said power supply upon occurrence of said note demand on said already-actuated valve for said interruption time period ($\Delta t$), and (ii) at the end of said interruption time period ($\Delta t$), again set said power supply up to said certain value ($I_1$) to open said valve again.

24. A pipe organ in accordance with claim 13, additionally comprising means for actuating said actuatable valve on the basis of at least two different note demands, said means comprising a corresponding setting on said console (34) such as a stop switch.

* * * * *